US009889688B2

(12) United States Patent
Ehara

(10) Patent No.: US 9,889,688 B2
(45) Date of Patent: Feb. 13, 2018

(54) PRINTING UNIT AND PRINTER

(71) Applicant: SEIKO SOLUTIONS INC., Chiba-shi, Chiba (JP)

(72) Inventor: Koji Ehara, Matsudo (JP)

(73) Assignee: SEIKO SOLUTIONS INC., Chiba (JP)

( * ) Notice: Subject to any disclaimer, the term of this patent is extended or adjusted under 35 U.S.C. 154(b) by 0 days.

(21) Appl. No.: 15/248,742

(22) Filed: Aug. 26, 2016

(65) Prior Publication Data

US 2017/0057261 A1 Mar. 2, 2017

(30) Foreign Application Priority Data

Aug. 31, 2015 (JP) ..... 2015-170360

(51) Int. Cl.
*B41J 25/00* (2006.01)
*B41J 2/01* (2006.01)
*B41J 19/14* (2006.01)

(52) U.S. Cl.
CPC ..... *B41J 25/001* (2013.01); *B41J 2/01* (2013.01); *B41J 19/14* (2013.01)

(58) Field of Classification Search
CPC combination set(s) only.
See application file for complete search history.

(56) References Cited

U.S. PATENT DOCUMENTS 3,855,448 A * 12/1974 Hanagata ..... B41J 2/325 347/171
3,989,131 A * 11/1976 Knirsch ..... B41J 2/32 347/198
4,189,244 A * 2/1980 Harrison ..... B41J 25/3088 400/320
4,210,076 A * 7/1980 Yamamoto ..... B41J 11/20 101/111
4,268,177 A * 5/1981 Veale ..... B41J 25/308 400/144.3

(Continued)

FOREIGN PATENT DOCUMENTS

JP 07-214832 A 8/1995

*Primary Examiner* — Matthew Luu
*Assistant Examiner* — Lily Kemathe
(74) *Attorney, Agent, or Firm* — Brinks Gilson & Lione

(57) ABSTRACT

A printing unit includes a carriage, a printing head mounted on the carriage, a guide pillar configured to support the carriage to be reciprocatingly movable in the front-back direction, a unit frame configured to support the guide pillar to be movable in the left-right direction, and a line-feed mechanism configured to move the carriage in the left-right direction. The line-feed mechanism includes a line-feed plate supported by the guide pillar to be movable in the front-back direction and a guide member configured to engage with the line-feed plate and guide the line-feed plate in the left-right direction together with the guide pillar according to the movement in the front-back direction of the line-feed plate. The line-feed plate includes a forward-path engaging section with which the carriage engages in a process from a forward-path start point to a forward-path end point in the front-back direction and a backward-path engaging section with which the carriage engages in a process from a backward-path start point to a backward-path end point in the front-back direction.

9 Claims, 14 Drawing Sheets

(56) References Cited

U.S. PATENT DOCUMENTS 4,277,189 A * 7/1981 Howard ..... B41J 19/142 346/139 B
4,469,459 A * 9/1984 Trezise ..... B41J 35/22 400/208
4,526,486 A * 7/1985 Kikuchi ..... B41J 19/20 400/185
4,641,150 A * 2/1987 Matsuura ..... B41J 33/388 346/105
4,775,252 A * 10/1988 Applegate ..... B41J 25/316 347/197
5,764,250 A * 6/1998 Tenenbaum ..... B41J 11/08 346/80
6,450,710 B1 * 9/2002 Foster ..... B41J 11/20 347/37
2003/0081972 A1 * 5/2003 Miranda ..... B41J 25/308 400/55
2003/0112303 A1 * 6/2003 Park ..... B41J 25/3082 347/85
2004/0047665 A1 * 3/2004 DeVore ..... B41J 25/3088 400/55
2005/0052510 A1 * 3/2005 Ju ..... B41J 2/1752 347/86
2005/0162494 A1 * 7/2005 Inokuchi ..... B41J 13/106 347/104
2006/0193670 A1 * 8/2006 Fukumasu ..... B41J 3/4071 400/144.2
2006/0257185 A1 * 11/2006 Furihata ..... B41J 25/3088 400/55
2007/0081181 A1 * 4/2007 Nobuta ..... B41J 3/4071 358/1.13
2009/0284556 A1 * 11/2009 Okazawa ..... B41J 25/308 347/8
2010/0002049 A1 * 1/2010 Ueda ..... B41J 25/3086 347/37
2010/0073700 A1 * 3/2010 Uematsu ..... B41J 3/4071 358/1.13
2012/0044310 A1 * 2/2012 Yajima ..... B41J 2/1752 347/104
2012/0127254 A1 * 5/2012 Yamamoto ..... B41J 2/335 347/200
2012/0147118 A1 * 6/2012 Daicho ..... B41J 2/335 347/202
2013/0215200 A1 * 8/2013 Obata ..... H05K 3/40 347/58
2014/0063091 A1 * 3/2014 Ehara ..... B41J 25/308 347/8
2014/0063167 A1 * 3/2014 Kanemoto ..... B41J 25/3088 347/108

* cited by examiner

PRINTING UNIT AND PRINTER

RELATED APPLICATIONS

This application claims priority under 35 U.S.C. § 119 to Japanese Patent Application No. 2015-170360 filed on Aug. 31, 2015, the entire content of which is hereby incorporated by reference.

BACKGROUND OF THE INVENTION

1. Field of the Invention

The present invention relates to a printing unit and a printer.

2. Description of the Related Art

A printer of a dot impact type is known as a printer used for a timestamp or the like. The printer of this type includes a carriage that reciprocatingly moves in a row direction, a printing head mounted on the carriage, and a cartridge mounted on the carriage and having an ink ribbon housed therein (see, for example, Japanese Patent No. 2791350 (Patent Literature 1)).

The printer performs printing on a recording medium by hitting head pins of the printing head against the recording medium via the ink ribbon in a process in which the carriage reciprocatingly moves in the row direction on the recording medium.

However, the printer described in Patent Literature 1 performs the printing only while the carriage moves on a forward path. Therefore, an information amount that can be printed in one reciprocating movement is limited. In general, in the printer used for the timestamp or the like, printing is performed in a state in which a recording medium is fixed. Therefore, the recording medium cannot be conveyed in a column direction orthogonal to the row direction.

Therefore, there is still room of improvement of marketability.

SUMMARY OF THE INVENTION

Therefore, the present invention has been devised in view of the circumstances and an object of the present invention is to provide a printing unit and a printer that can improve marketability.

In order to solve the problem, a printing unit of the present invention includes: a carriage; a printing head mounted on the carriage; a guide pillar configured to support the carriage to be reciprocatingly movable in a row direction; a unit frame configured to support the guide pillar to be movable in a column direction orthogonal to the row direction; and a line-feed mechanism configured to move the carriage in the column direction. The line-feed mechanism includes: a line-feed plate supported by the guide pillar to be movable in the row direction; and a guide member configured to engage with the line-feed plate and guide the line-feed plate in the column direction together with the guide pillar according to the movement in the row direction of the line-feed plate. The line-feed plate includes: a forward-path engaging section with which the carriage engages in a process from a forward-path start point to a forward-path end point in the row direction; and a backward-path engaging section with which the carriage engages in a process from a backward-path start point to a backward-path end point in the row direction.

With this configuration, the carriage engages with the forward-path engaging section of the line-feed plate during the movement on the forward path. Therefore, when the carriage moves to the forward-path end point thereafter, the carriage moves to one side in the column direction together with the line-feed plate. On the other hand, the carriage engages with the backward-path engaging section of the line-feed plate during the movement on the backward path. Therefore, when the carriage moves to the backward-path end point thereafter, the carriage moves to the other side in the column direction together with the line-feed plate. That is, the carriage moves in different positions in the column direction between the forward path and the backward path. In this case, for example, by performing printing by the printing head in both of the forward path and the backward path, it is possible to perform printing in different printing regions in two columns in the column direction on a recording medium. As a result, it is possible to improve an information amount that can be printed at a time and improve marketability.

In particular, since the carriage is moved in the column direction according to the movement in the row direction, it is possible to perform a line-feed operation of the carriage with one driving source. Therefore, it is possible to realize simplification and a reduction in costs compared with, for example, when the line-feed operation of the carriage is performed by two driving sources, that is, a driving source for performing the movement in the row direction and a driving source for performing the movement in the column direction.

In the printing unit according to the present invention, in one member of the line-feed plate and the guide member, an engaging projecting section projecting toward the other member may be formed, an engaging recessed section, with which the engaging projecting section engages, may be formed in the other member, and the engaging recessed section may extend to the one side in the column direction toward one side in the row direction.

With this configuration, the engaging recessed section extends to the one side in the column direction toward the one side in the row direction. Therefore, it is possible to smoothly move the carriage in the column direction according to the movement in the row direction of the carriage.

In the printing unit according to the present invention, a locking section, which the engaging projecting section can climb over, may be formed in the center in an extending direction in the engaging recessed section on the inner surface of the engaging recessed section.

With this configuration, in a state in which the engaging projecting section is located at both end portions in the extending direction in the engaging recessed section, the movement of the engaging projecting section to the center in the extending direction is regulated by the locking section. Consequently, for example, when a shock acts on the printing unit from the outside, it is possible to suppress the line-feed plate from suddenly moving. Note that, during line-feed of the carriage to the backward-path start point (the forward-path end point) and during return of the carriage to the backward-path end point (the forward-path start point), the line-feed plate moves together with the carriage in a state in which the carriage engages with the forward-path engaging section or the backward-path engaging section. Therefore, the engaging projecting section climbs over the locking section.

In the printing unit according to the present invention, the guide member may include a cam member configured to be rotatable on the unit frame around an axis orthogonal to the row direction and the column direction, and the cam member may engage with the line-feed plate in a position eccentric with respect to the axis and move the line-feed plate in the column direction together with the guide pillar according to the movement in the row direction of the line-feed plate.

With this configuration, when the cam member rotates according to the movement in the row direction of the carriage, the line-feed plate moves in the column direction. Consequently, it is possible to smoothly move the carriage in the column direction.

In the printing unit according to the present invention, the cam member may include a cam gear formed in a position eccentric with respect to the axis, and the line-feed plate may include a line-feed rack configured to mesh with the cam gear.

With this configuration, the cam member and the line-feed plate are engaged by the cam gear and the line-feed rack. Therefore, it is possible to reduce a load acting on an engaging portion while achieving simplification.

In the printing unit according to the present invention, the printing unit may further include: a driving source configured to move the carriage in the row direction; a printing frame mounted with the driving source and configured to support the guide pillar; and a bearing section provided in the unit frame, configured to support the guide pillar to be reciprocatingly movable in the column direction, and coupled to the printing frame to regulate a swing of the printing frame around the guide pillar.

With this configuration, the bearing section regulates the swing of the printing frame around the guide pillar while supporting the guide pillar to be movable in the column direction. Therefore, it is possible to achieve a reduction in the number of components, a reduction in costs, and improvement of assemblability compared with when the support of the guide plate and the regulation of the swing of the printing frame are performed by separate components.

In the printing unit according to the present invention, the printing head may be an impact type and include a winding mechanism connected to a cartridge detachably attached to the carriage and configured to wind an ink ribbon in the cartridge, the winding mechanism may include: a winding gear disposed in the carriage; and a rack plate including a winding rack that meshes with the winding gear, and, the winding gear may rotate according to the movement in the row direction of the carriage and the winding mechanism may perform the winding of the ink ribbon.

With this configuration, the ink ribbon is wound according to the movement of the carriage. Therefore, it is possible to suppress occurrence of a change in printing concentration, printing blur, and the like and keep printing quality satisfactorily.

In the printing unit according to the present invention, the rack plate may include chipped tooth regions for releasing the meshing of the winding gear and the winding rack at both end portions in the row direction.

With this configuration, the chipped tooth regions for releasing the meshing of the winding gear and the winding rack are formed. Therefore, during line-feed of the carriage to the backward-path start point (the forward-path end point) and during return of the carriage to the backward-path end point (the forward-path start point), when the carriage passes both the end portions in the row direction of the rack plate, the winding gear does not rotate according to the movement of the carriage. That is, while the carriage is moving in the chipped tooth regions, the winding of the ink ribbon is not performed. Therefore, it is possible to suppress load torque required for the winding during the line-feed and during the return from acting on the driving source and smoothly perform the line-feed operation. Since it is possible to suppress the ink ribbon from being uselessly wound during the line-feed, it is possible to effectively use the ink ribbon.

A printer according to the present invention includes: the printing unit of the present invention; and a casing configured to house the printing unit and including a slot into which a recording medium is inserted.

With this configuration, since the printer includes the printing unit of the present invention, it is possible to improve marketability.

According to the present invention, it is possible to provide the printing unit and the printer that can improve marketability.

DETAILED DESCRIPTION OF THE INVENTION

Embodiments of the present invention are explained with reference to the drawings.

First Embodiment

Printer

Figure 1:
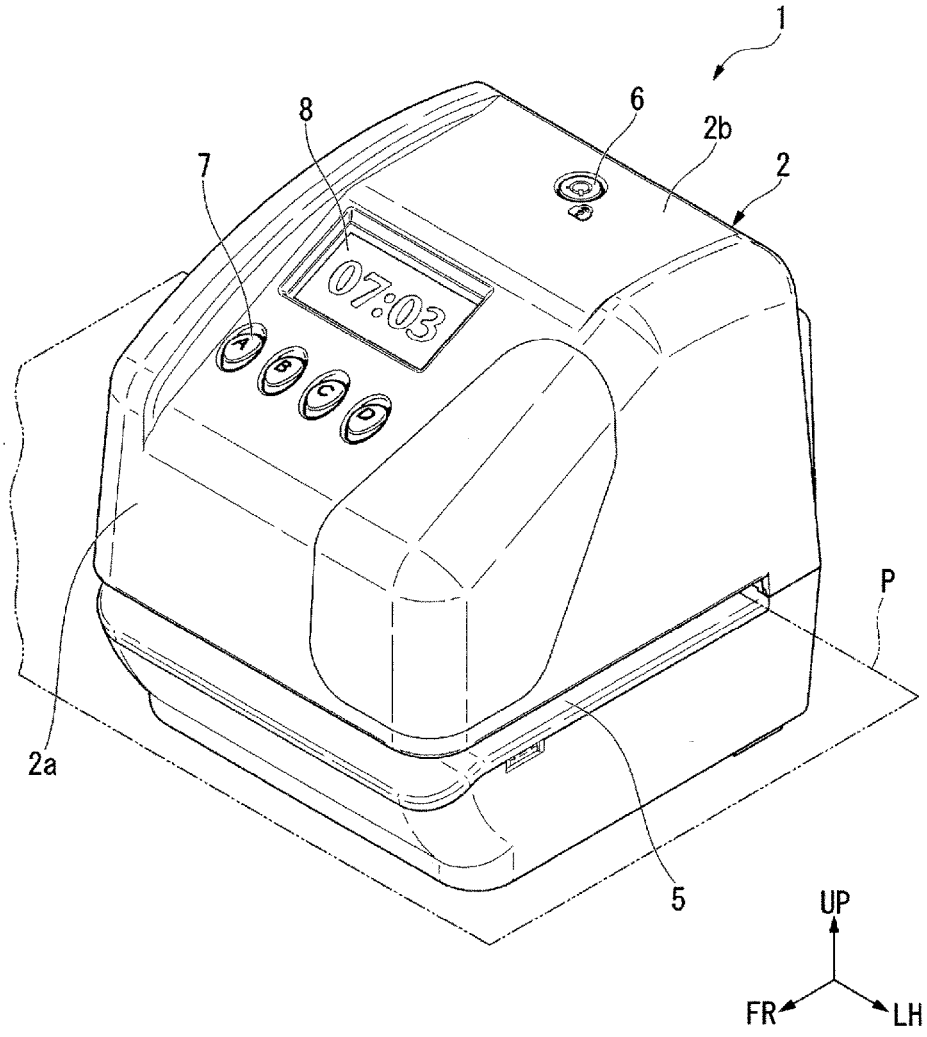
FIG. 1 is a perspective view of a printer according to a first embodiment viewed from the left side.

FIG. 1 is an exterior perspective view of a printer 1 viewed from the left side.

As shown in FIG. 1, the printer 1 in this embodiment is used for a timestamp or the like. The printer 1 prints information concerning time such as a date and time of day in a printing region of card-like recording paper P (a recording medium). Specifically, the printer 1 includes a casing 2 and a printing unit 3 (see FIG. 2) housed in the casing 2. Note that, in the following explanation, the lower left side of the paper surface in FIG. 1 is referred to as front (arrow FR direction), the upper right side is referred to as back, the upper side is referred to upward (arrow UP direction), and the lower side is referred to as downward. In FIG. 1, the lower right side with respect to the paper surface is referred to as left side (arrow LH direction) when viewed from the printer 1 and the upper left side is referred to as right side when viewed from the printer 1.

The casing 2 is configured by a resin material or the like. The casing 2 is formed in a rectangular parallelepiped shape. On a front wall 2*a* of the casing 2, a slot 5 recessed backward is formed in the center in the up-down direction. Recording paper P is removably inserted into the slot 5 from the front. Note that the slot 5 pierces through the casing 2 in the left-right direction. The thickness of the recording paper P can be changed as appropriate as long as the recording paper P can be removably inserted into the slot 5.

On an upper wall 2*b* of the casing 2, a keyhole 6, operation buttons 7 for performing various kinds of operation, and a display section 8 that displays time of day and the like are disposed. Note that, in the example shown in FIG. 1, the front part of the upper wall 2*b* inclines downward toward the front.

Printing Unit

Figure 2:
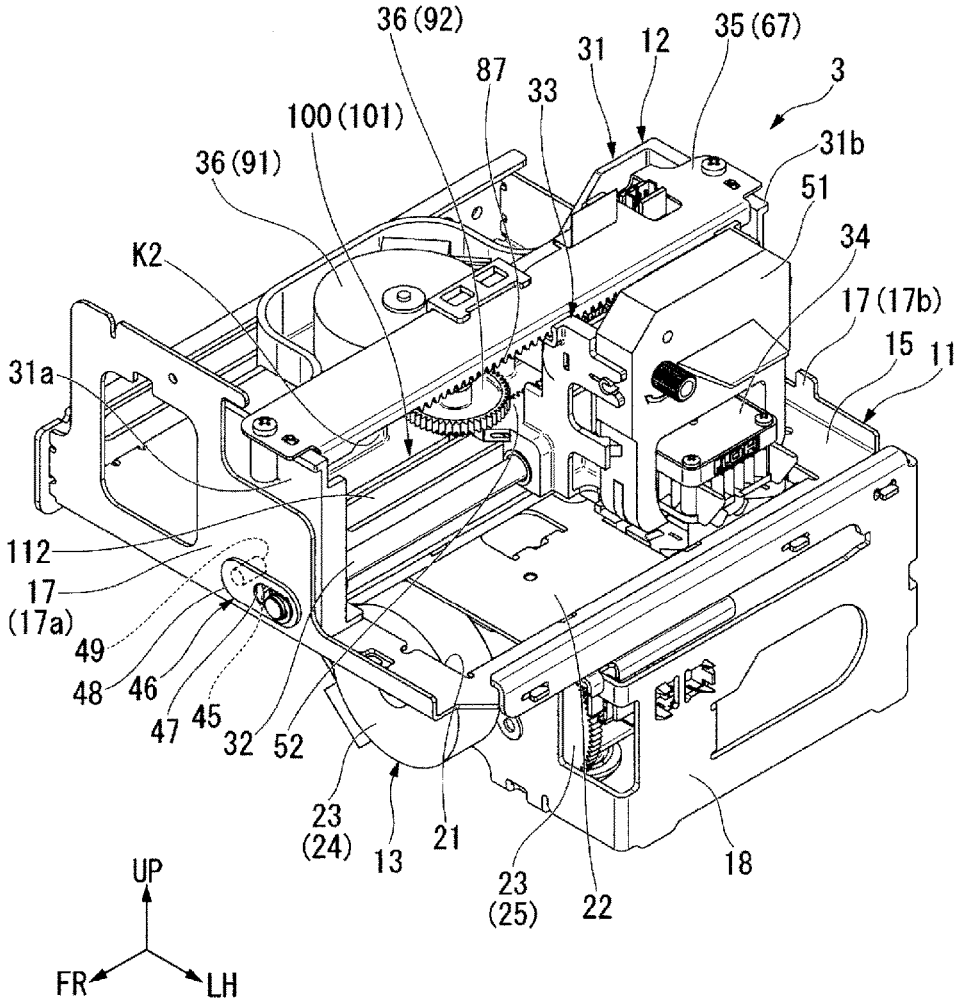
FIG. 2 is a perspective view of a printing unit according to the first embodiment viewed from the left side.

FIG. 2 is a perspective view of the printing unit 3 viewed from the left side.

Figure 3:
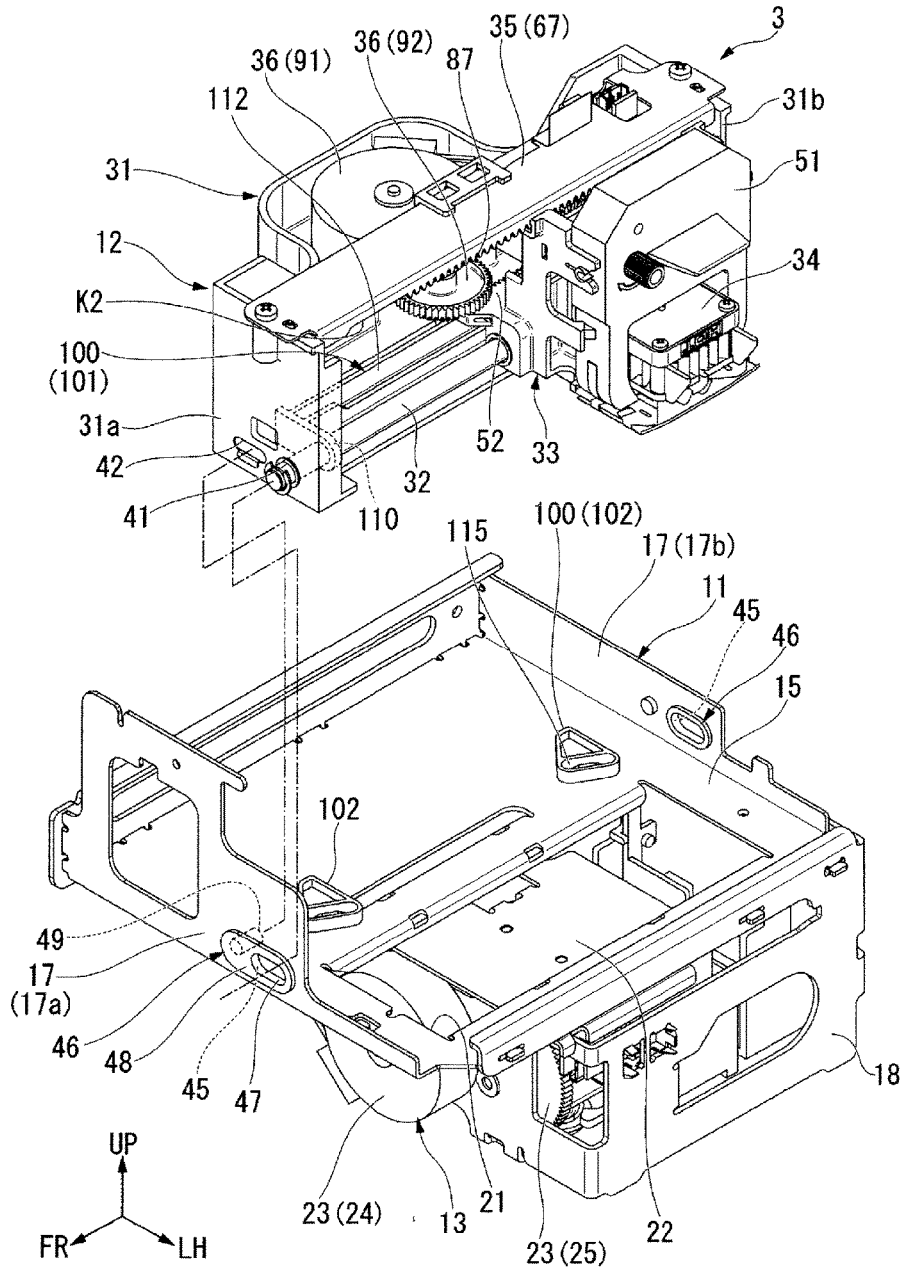
FIG. 3 is an exploded perspective view of the printing unit shown in FIG. 2.

FIG. 3 is an exploded perspective view of the printing unit 3 shown in FIG. 2.

As shown in FIGS. 2 and 3, the printing unit 3 mainly includes a unit frame 11 and a printing block 12 and a platen block 13 mounted on the unit frame 11.

The unit frame 11 is configured by bending metal or the like. Specifically, the unit frame 11 includes a frame base 15, printing-block supporting sections 17 that support the printing block 12, and a platen supporting section 18 that supports the platen block 13.

The frame base 15 is formed in a rectangular shape in plan view from above. At the left side end portion in the frame base 15, an opening for printing 21 piercing through the frame base 15 in the up-down direction is formed. Not-shown stopper rubber is attached to an opening edge of the opening for printing 21 in the frame base 15 from below. Note that the frame base 15 is located above the slot 5.

The printing-block supporting sections 17 include supporting walls 17*a* and 17*b* erected to be directed upward from the front and rear both end portions of the frame base 15.

The platen supporting section 18 is located below the frame base 15. The platen supporting section 18 is formed in a rectangular frame shape in plan view from above. Note that the platen supporting section 18 is located below the slot 5. That is, the recording paper P inserted into the slot 5 enters between the frame base 15 and the platen supporting section 18 from the front.

The platen block 13 includes a platen main body 22 and a platen driving mechanism 23 that drives the platen main body 22.

The platen main body 22 is formed in a tabular shape in plan view from above. The platen main body 22 is supported to be movable up and down by the platen supporting section 18. Specifically, the platen main body 22 moves up and down between a holding position where the platen main body 22 comes into contact with the frame base 15 from below and a retracting position where the platen main body 22 separates from the frame base 15 downward. Note that, in the holding position, the platen main body 22 comes into contact with the frame base 15 via the stopper rubber attached to the frame base 15. In the retracting position, the platen main body 22 retracts further downward than the slot 5.

The platen driving mechanism 23 includes a platen motor 24 and a platen wheel train 25 that connects the platen motor 24 and the platen main body 22.

The printing block 12 mainly includes a printing frame 31, a guide pillar 32, a carriage 33, a printing head 34, a winding mechanism 35, and a driving mechanism for printing 36.

The printing frame 31 is formed in a box shape opened upward and on the left side. As shown in FIG. 3, in lower parts of a front wall 31*a* and a rear wall 31*b* in the printing frame 31, through-holes 41 (in FIG. 3, only the through-hole 41 of the front wall 31*a* is shown) respectively piercing through the front wall 31*a* and the rear wall 31*b* in the front-back direction (the row direction) are formed.

On the front wall 31*a* and the rear wall 31*b*, regulating recessed sections 42 (in FIG. 3, only the regulating recessed section 42 of the front wall 31*a* is shown) recessed toward the inner side in the front-back direction are formed in portions located on the right side with respect to the through-holes 41. The regulating recessed section 42 is formed in an elliptical shape having a longitudinal direction in the left-right direction (the column direction) in front view from the front-back direction.

The guide pillar 32 is formed in a columnar shape having an axial direction in the front-back direction. Front and rear both end portions of the guide pillar 32 are particularly supported in the through-holes 41 formed in the lower parts of the front wall 31*a* and the rear wall 31*b*. In the guide pillar 32, portions located on the outer side in the front-back direction with respect to the front wall 31*a* and the rear wall 31*b* are supported by the supporting walls 17*a* and 17*b* of the printing-block supporting sections 17. Specifically, in the supporting walls 17*a* and 17*b*, shaft supporting holes 45 piercing through the supporting walls 17*a* and 17*b* in the front-back direction are formed. The front and rear both end portions of the guide pillar 32 are respectively supported in the shaft supporting holes 45 via bearing sections 46.

The shaft supporting holes 45 are long holes having a longitudinal direction in the left-right direction. Therefore, the guide pillar 32 is configured to be movable in the left-right direction in the shaft supporting holes 45.

The bearing sections 46 include collar sections 47 inserted into the shaft supporting holes 45, flange sections 48 protruding from outer side end portions in the front-back direction in the collar sections 47, and protrusion sections 49 projecting to the inner side in the front-back direction from the flange sections 48.

The collar sections 47 are formed in a cylindrical shape formed along the inner surfaces of the shaft supporting holes 45. The collar sections 47 cover the inner circumferential surfaces of the shaft supporting holes 45. Therefore, the guide pillar 32 is supported in the shaft supporting holes 45 via the collar sections 47.

The flange sections 48 are formed in an elliptical shape having a longitudinal direction in the left-right direction in plan view from the front-back direction. The collar sections 47 are consecutively connected to the left side end portions in the flange sections 48.

The protrusion sections 49 are disposed at the right side end portions in the flange sections 48. The protrusion sections 49 pierce through the supporting walls 17*a* and 17*b* of the printing-block supporting sections 17 and project to the inner side in the front-back direction with respect to the supporting walls 17*a* and 17*b*. Inner side end portions in the front-back direction in the protrusion sections 49 are respectively housed in the regulating recessed sections 42. When the protrusion sections 49 come into contact with the inner surfaces of the regulating recessed sections 42, the regulating recessed sections 42 regulate a swing of the printing block 12 around the guide pillar 32.

The carriage 33 is formed in a rectangular parallelepiped shape. The guide pillar 32 pierces through a lower part of the carriage 33 in the front-back direction. Consequently, the carriage 33 is supported by the guide pillar 32 to be reciprocatingly movable in the front-back direction.

A cartridge 51, in which a not-shown ink ribbon is housed, is detachably mounted on the carriage 33 from the left side.

A scanning rack 52 projecting toward the right side is formed in the carriage 33. The scanning rack 52 extends along the front-back direction.

Figure 4:
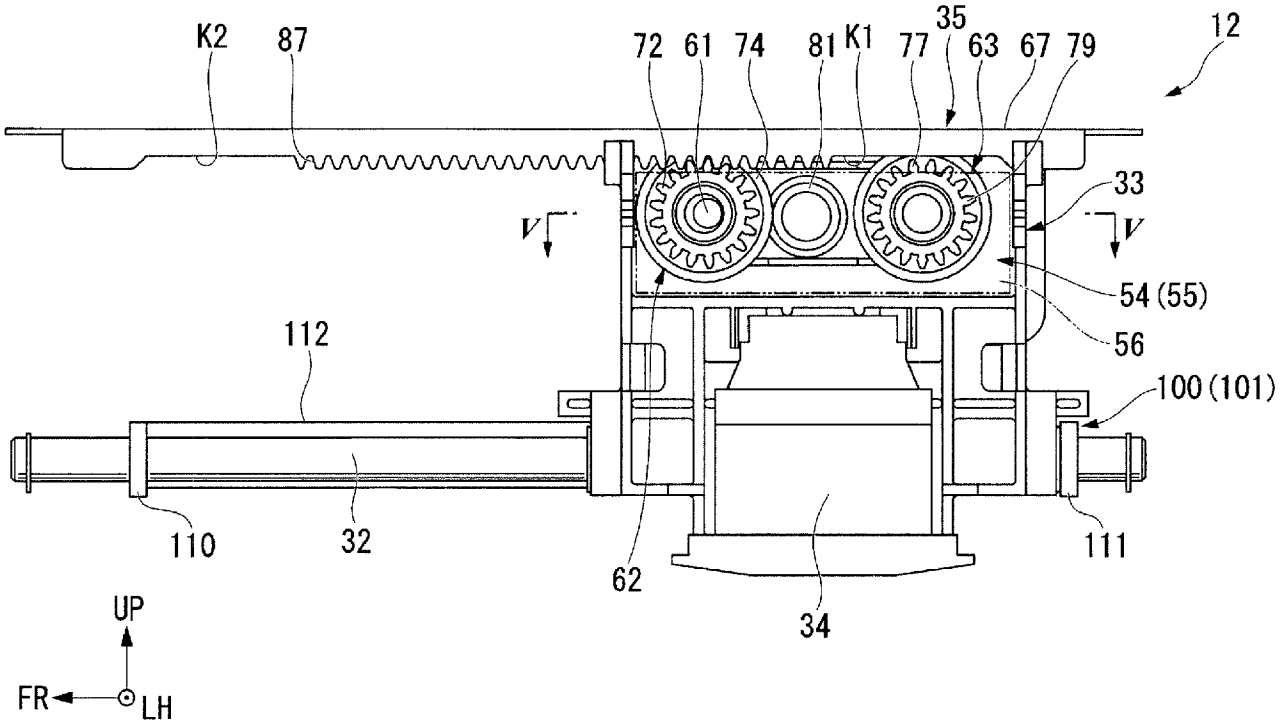
FIG. 4 is a side view of a printing block in a detached state of a cartridge according to the first embodiment viewed from the left side.

FIG. 4 is a side view of the printing block 12 in a detached state of the cartridge 51 viewed from the left side.

As shown in FIG. 4, a wheel-train housing section 54 is formed in an upper part of the carriage 33. The wheel-train housing section 54 includes a housing recessed section 55 opening toward the left side and a cover 56 that covers the housing recessed section 55 from the left side.

As shown in FIGS. 2 and 3, the printing head 34 is attached to a lower part of the carriage 33 from the left side. The printing head 34 faces the opening for printing 21 of the frame base 15 from above. A not-shown plurality of head pins movable up and down are incorporated in the printing head 34. The ink ribbon let out from the cartridge 51 is capable of traveling in the front-back direction below the printing head 34.

Figure 5:
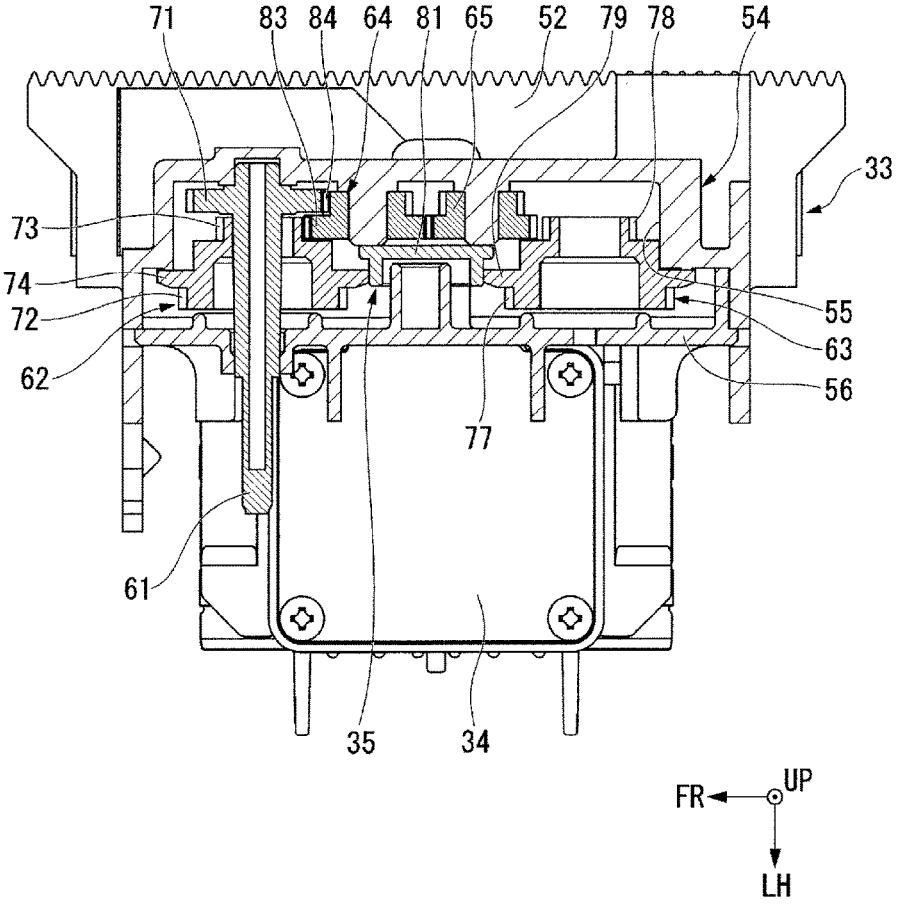
FIG. 5 is a sectional view corresponding to line V-V in FIG. 4.

FIG. 5 is a sectional view corresponding to line V-V in FIG. 4.

As shown in FIGS. 4 and 5, the winding mechanism 35 includes winding wheel trains 61 to 65 housed in the gear-train housing section 54 and a rack plate 67 disposed above the carriage 33.

The winding wheel trains 61 to 65 include a winding shaft 61, a first moving gear 62 and a second moving gear 63, and an intermediate gear 64 and a reverse gear 65 disposed between the first moving gear (winding gear) 62 and the second moving gear (winding gear) 63.

The winding shaft 61 is disposed in a portion located on the front side in the wheel-train housing section 54. The winding shaft 61 is supported in the wheel-train housing section 54 to be rotatable around an axis extending along the left-right direction. The left side end portion of the winding shaft 61 pierces through the cover 56 and projects to the outside of the wheel-train housing section 54. The left side end portion of the winding gear 61 is coupled to a not-shown bobbin of the cartridge 51. A transmission gear 71 protruding to the outer circumference side of the winding shaft 61 is formed at the right side end portion of the winding shaft 61.

The winding shaft 61 is inserted through the first moving gear 62 from the right side. The first moving gear 62 is supported in a portion located further on the left side than the transmission gear 71 in the winding shaft 61 to be rotatable around an axis extending along the left-right direction and movable in the front-back direction. The first moving gear 62 includes a first large gear 72 located on the left side, a first small gear 73 located on the right side, and a first flange section 74 located between the first large gear 72 and the first small gear 73 and larger in diameter than the first large gear 72. The upper end portions of the first large gear 72 and the first flange section 74 project upward from the wheel-train housing section 54.

The second moving gear 63 is disposed behind the first moving gear 62 in the wheel-train housing section 54. The second moving gear 63 is supported in the wheel-train housing section 54 to be rotatable around an axis extending along the left-right direction and movable in the front-back direction. The second moving gear 63 includes a second large gear 77 located on the left side, a second small gear 78 located on the right side, and a second flange section 79 located between the second large gear 77 and the second small gear 78 and larger in diameter than the second large gear 77. The large gears 72 and 77, the small gears 73 and 78, and the flange sections 74 and 79 of the moving gears 62 and 63 are respectively disposed in equivalent positions in the left-right direction. The upper end portions of the second large gear 77 and the second flange section 79 project upward from the wheel-train housing section 54.

In the wheel-train housing section 54, a spacer 81 is disposed in a position located between the moving gears 62 and 63. The spacer 81 is formed in a disk shape. The spacer 81 is supported in the wheel-train housing section 54 to be movable in the front-back direction. The flange sections 74 and 79 of the moving gears 62 and 63 come into contact with the spacer 81 from the outer side in the front-back direction. Consequently, a minimum inter-axis distance in the front-back direction between the moving gears 62 and 63 is maintained.

As shown in FIG. 5, the intermediate gear 64 is supported to be rotatable around an axis extending in the left-right direction in a portion located further on the right side than the spacer 81 in the wheel-train housing section 54. The intermediate gear 64 includes an intermediate large gear 83 located on the left side and an intermediate small gear 84 located on the right side.

Meshing and release of the meshing of the intermediate large gear 83 with the first small gear 73 are switched according to the movement in the front-back direction of the first moving gear 62.

The intermediate small gear 84 is in mesh with the transmission gear 71 of the winding shaft 61.

The reverse gear 65 is disposed behind the intermediate gear 64 in the wheel-train housing section 54. The reverse gear 65 is configured to be rotatable around an axis extending in the left-right direction. The reverse gear 65 meshes with the intermediate large gear 83. Meshing and release of the meshing of the reverse gear 65 with the second small gear 78 are switched according to the movement in the front-back direction of the second moving gear 63.

As shown in FIGS. 3 and 4, the rack plate 67 bridges the upper end portions of the front wall 31*a* and the rear wall 31*b* of the printing frame 31 explained above. At least a part of the rack plate 67 is disposed in a position overlapping the carriage 33 in plan view from the up-down direction. In the rack plate 67, a winding rack 87 projecting downward is extended in the front-back direction. The winding rack 87 is configured to be capable of meshing with the upper end portions (portions projecting from the wheel-train housing section 54) of the large gears 72 and 77 in the moving gears 62 and 63 from above. Note that the winding rack 87 is formed in a portion avoiding both the end portions in the front-back direction in the rack plate 67. That is, both the end portions in the front-back direction in the rack plate 67 are chipped tooth regions K1 and K2 (see FIG. 4) where the winding rack 87 is not formed.

The driving mechanism for printing 36 includes a printing motor (a driving source) 91 capable of regularly and reversely rotating and a scanning gear 92 that connects the printing motor 91 and the carriage 33.

The printing motor 91 is disposed in a portion located further on the right side than the carriage 33 in the printing frame 31.

The scanning gear 92 connects the printing motor 91 and the carriage 33 in the printing frame 31. The scanning gear 92 meshes with a not-shown output gear coupled to an output shaft of the printing motor 91 and meshes with the scanning rack 52 of the carriage 33. A driving force of the printing motor 91 is transmitted to the carriage 33 via the scanning gear 92 and the scanning rack 52. Therefore, the carriage 33 reciprocatingly moves in the front-back direction along the guide pillar 32.

As shown in FIG. 3, the printing unit 3 in this embodiment includes a line-feed mechanism 100 that moves the carriage 33 in the left-right direction. The line-feed mechanism 100 includes a line-feed plate 101 supported by the guide pillar 32 to be movable in the front-back direction and guide members 102 that guide the line-feed plate 101 in the left-right direction according to the movement in the front-back direction of the line-feed plate 101.

Figure 6:
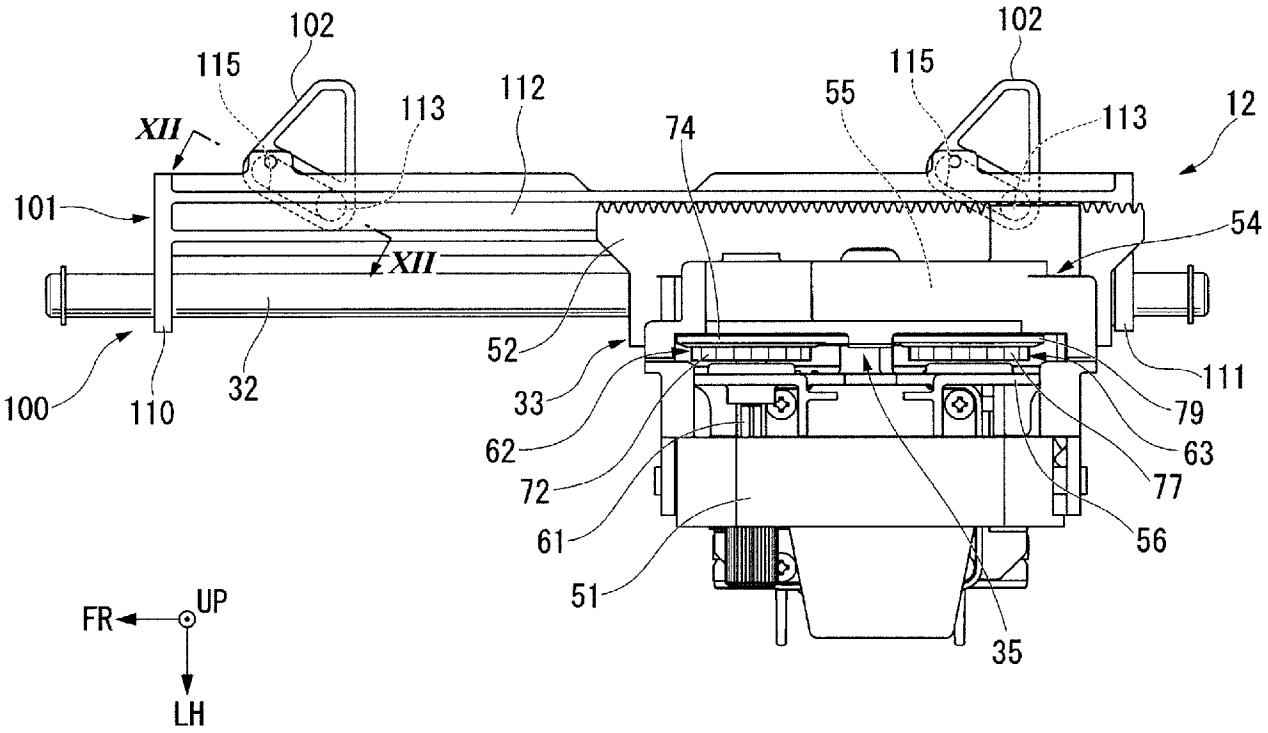
FIG. 6 is a plan view of a carriage and a line-feed mechanism according to the first embodiment.

FIG. 6 is a plan view of the carriage 33 and the line-feed mechanism 100.

As shown in FIG. 6, the line-feed plate 101 is formed in a C-shape that opens to the left side in plan view from the up-down direction. Specifically, the line-feed plate 101 includes a forward-path engaging section 110 located in front of the carriage 33, a backward-path engaging section 111 located behind the carriage 33, and a line-feed base 112 that bridges the engaging sections 110 and 111.

The guide pillar 32 pierces through the left side end portion of the forward-path engaging section 110. The forward-path engaging section 110 is opposed to the carriage 33 in the front-back direction. Consequently, the carriage 33 engages (comes into contact) with the forward-path engaging section 110 from the back according to forward movement (a forward path) of the carriage 33. Note that the forward-path engaging section 110 is located in front of the winding rack 87.

The guide pillar 32 pieces through the left side end portion of the backward-path engaging section 111. The backward-path engaging section 111 is opposed to the carriage 33 in the front-back direction. Consequently, the carriage 33 engages (comes into contact) with the backward-path engaging section 111 from the front according to backward movement (a backward path) of the carriage 33. Note that the backward-path engaging section 111 is located behind the winding rack 87. In the example shown in FIG. 4, the distance between the inner side end faces in the front-back direction in the engaging sections 110 and 111 is longer than the distance between the outer side end edges in the front-back direction in the chipped tooth regions K1 and K2.

As shown in FIG. 6, the line-feed base 112 is formed in a tabular shape extending in parallel to the guide pillar 32 along the front-back direction. The line-feed base 112 connects the right side end portions of the engaging sections 110 and 111. A pair of engaging projecting sections 113 projecting downward is formed at both the end portions in the front-back direction in the line-feed base 112.

The guide members 102 are respectively disposed in positions overlapping the line-feed plate 101 in the up-down direction at both the end portions in the front-back direction of the frame base 15. In the guide members 102, engaging recessed sections 115, in which the engaging projecting sections 113 are housed from above, are formed in positions overlapping the engaging projecting sections 113 in the up-down direction. The engaging recessed sections 115 incline toward the right side (one side in the column direction) toward the front (one side in the row direction). Note that an inclination angle, dimensions, and the like of the engaging recessed sections 115 can be changed as appropriate.

Operation Method for the Printer

An operation method for the printer 1 is explained.

First, as shown in FIG. 1, the recording paper P is inserted into the slot 5 from the front side. The recording paper P entered the slot 5 is disposed between the frame base 15 and the platen supporting section 18 shown in FIG. 2 in the casing 2. When the recording paper P reaches a predetermined position in the slot 5, the platen block 13 is actuated. Specifically, when the platen motor 24 is actuated, a driving force of the platen motor 24 is transmitted to the platen main body 22 via the platen wheel train 25. Then, since the platen main body 22 rises, the recording paper P is held between the platen main body 22 and the frame base 15.

Subsequently, the printing block 12 is actuated. In the printer 1 in this embodiment, when the carriage 33 reciprocatingly moves in the front-back direction, the carriage 33 passes different positions in the left-right direction in the forward path and the backward path. The printer 1 performs printing in both of the forward path and the backward path. Therefore, the printer 1 can perform printing for two rows on the recording paper P.

Specifically, the printer 1 in this embodiment includes a forward-path printing step, a line-feed step, a backward-path printing step, and a carriage-return step.

In the forward-path printing step, the printer 1 performs printing for a first row on the recording paper P in a process in which the carriage 33 moves forward from a forward-path start point.

In the line-feed step, after the printing for the first low is performed on the recording paper P, the carriage 33 moves to the right side (a second row) while moving forward in a process for moving to a forward-path end point.

In the backward-path printing step, the printer 1 performs printing for the second row on the recording paper P in a process in which the carriage 33 moves backward from a backward-path start point (the forward-path end point).

In the carriage-return step, after the printing for the second row is performed on the recording paper P, the carriage 33 moves to the left side while moving backward in a process in which the carriage 33 moves to a backward-path end point (the forward-path start point). Note that, in the following explanation, a point where the carriage 33 is located on the rear side in the printing frame 31 is the forward-path start point (the backward-path end point). At the forward-path start point, the second moving gear 63 is located in the chipped tooth region K1 (see FIG. 4) on the rear side in the rack plate 67. The meshing of the winding rack 87 and the second large gear 77 is released. At the forward-path start point, the carriage 33 is separated from at least the forward-path engaging section 110 backward.

Forward-path Printing Step

As shown in FIGS. 2, 4, and 6, in the forward-path printing step, when the printing motor 91 regularly rotates, a driving force of the printing motor 91 is transmitted to the scanning rack 52 via the scanning gear 92. Then, the carriage 33 moves forward from the forward-path start point. At this point, as shown in FIGS. 4 and 5, since the first large gear 72 is in mesh with the winding rack 87, the first moving gear 62 moves backward relatively to the carriage 33 according to the forward movement of the carriage 33. Consequently, as shown in FIG. 5, the first small gear 73 of the first moving gear 62 meshes with the intermediate large gear 83.

Figure 7:
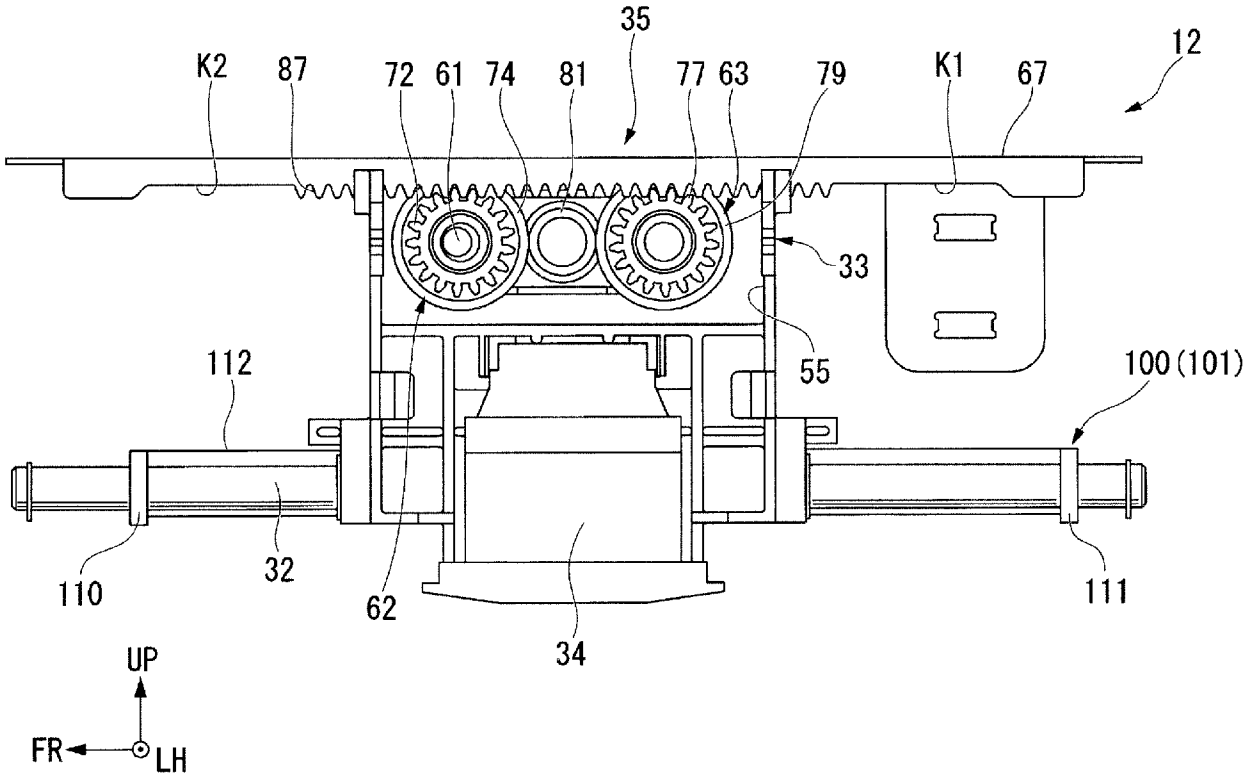
FIG. 7 is an explanatory diagram for explaining an operation method for the printer according to the first embodiment and is a side view equivalent to FIG. 4.
Figure 8:
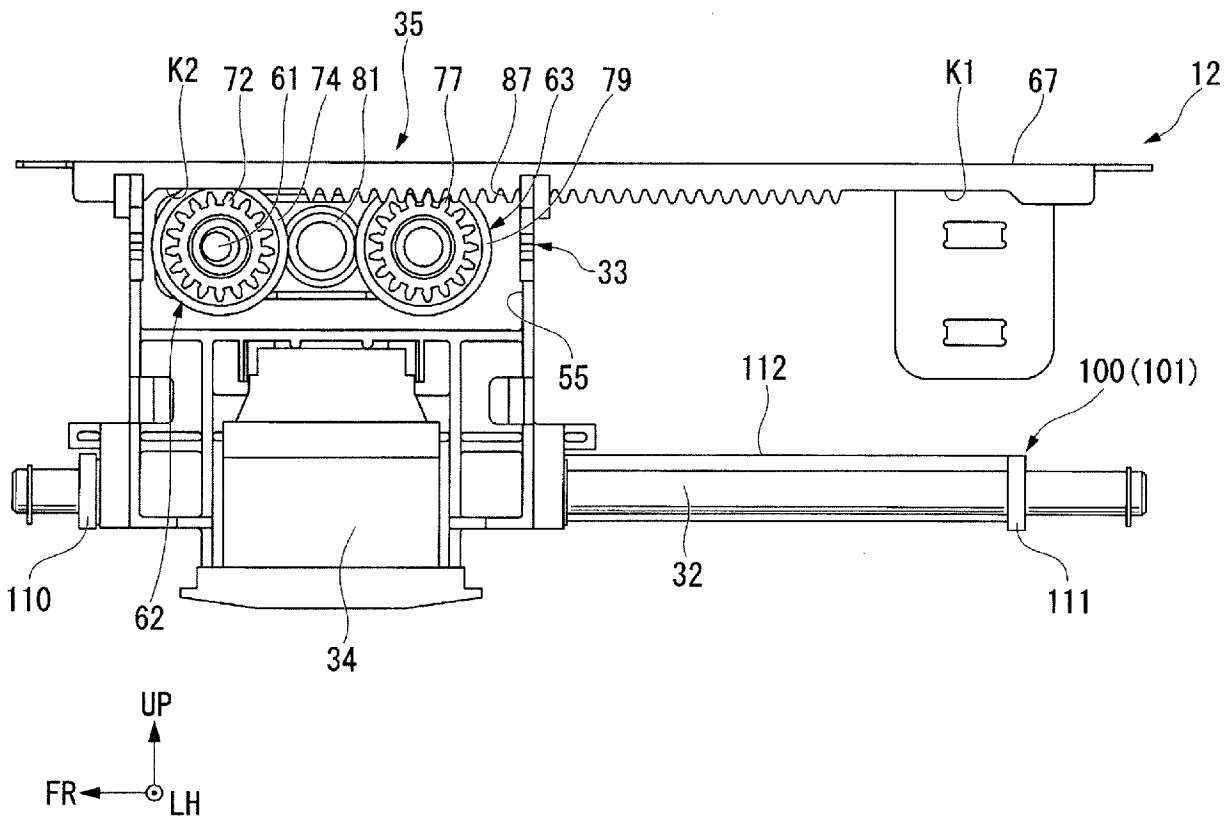
FIG. 8 is an explanatory diagram for explaining an operation method for the printer according to the first embodiment and is a side view equivalent to FIG. 4.

FIGS. 7 and 8 are explanatory diagrams for explaining the operation method for the printer 1 and are side views equivalent to FIG. 4. Note that, in FIGS. 7 and 8, the cartridge 51, the cover 56, and the like are not shown.

Thereafter, as shown in FIGS. 5 and 7, when the carriage 33 further moves forward, the first moving gear 62 rotates to one side around an axis. When the first moving gear 62 rotates to the one side, the intermediate gear 64 rotates in the opposite direction of the rotation of the first moving gear 62 (the other side). When the intermediate gear 64 rotates, the reverse gear 65 and the winding shaft 61 rotate in the opposite direction of the rotation of the intermediate gear 64 (the one side). When the winding shaft 61 rotates, a bobbin of the cartridge 51 rotates. Consequently, the carriage 33 moves forward while the ink ribbon of the cartridge 51 is wound. Note that, in the forward-path printing step, when the second moving gear 63 slips out of the chipped tooth region K1 on the rear side and meshes with the winding rack 87, the second moving gear 63 moves backward with respect to the carriage 33. Consequently, as shown in FIG. 5, the meshing of the second small gear 78 of the second moving gear 63 and the reverse gear 65 is released. That is, in the forward-path printing step, in a state in which the second large gear 77 is in mesh with the winding rack 87, when the second small gear 78 separates from the reverse gear 65, the second moving gear 63 idles.

As shown in FIG. 2, in the forward-printing step, when the recording paper P is hit by the head pins of the printing head 34 via the ink ribbon, printing in a first row is performed on the recording paper P. Thereafter, when the printing head 34 passes a printing region of the first row of the recording paper P, the forward-path printing step ends.

Line-feed Step

Figure 9:
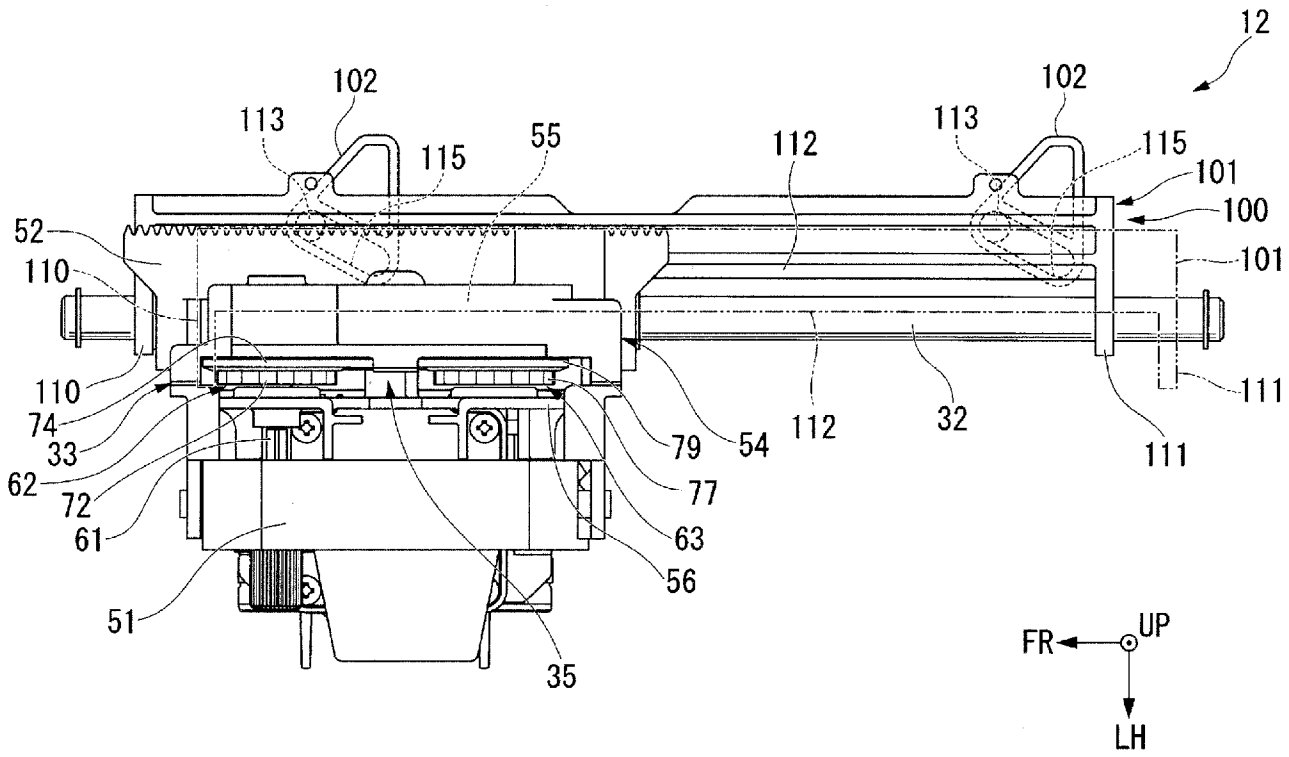
FIG. 9 is an explanatory diagram for explaining the operation method for the printer according to the first embodiment and is a plan view of the carriage and the line-feed mechanism.

FIG. 9 is an explanatory diagram for explaining the operation method for the printer 1 and is a plan view of the carriage 33 and the line-feed mechanism 100.

As shown in FIGS. 8 and 9, in the line-feed step, after the printing head 34 passes the printing region of the first row of the recording paper P, the carriage 33 comes into contact with the forward-path engaging section 110 of the line-feed plate 101 from the back. When the carriage 33 further moves forward in this state, the line-feed plate 101 moves forward together with the carriage 33. Since the engaging projecting sections 113 are engaged in the engaging recessed sections 115, the line-feed plate 101 moves to the right side toward the front. Consequently, the entire printing block 12 moves to the right side toward the front.

At a point in time when the engaging projecting sections 113 approach or come into contact with the front end portions of the engaging recessed sections 115, the carriage 33 reaches the forward-path start point (the backward-path end point). At this point in time, the driving in the regular rotation direction of the printing motor 91 is once stopped. Note that, after the carriage 33 passes the printing region of the first row in the recording paper P and before or after the carriage 33 comes into contact with the forward-path engaging section 110, the first moving gear 62 enters the chipped tooth region K2 on the front side in the rack plate 67. Therefore, before or after approach to the line-feed step, the first moving gear 62 does not rotate and the winding of the ink ribbon is not performed. Note that timing when the first moving gear 62 enters the chipped tooth region K2 can be changed as appropriate.

Backward-path Printing Step

In the backward-path printing step, when the printing motor 91 is reversely rotated in a state in which the carriage 33 is located at the backward-path start point (the forward-path end point), the carriage 33 moves backward. At this point, the carriage 33 moves backward in a portion (the backward path) located on the right side with respect to the forward path.

Figure 10:
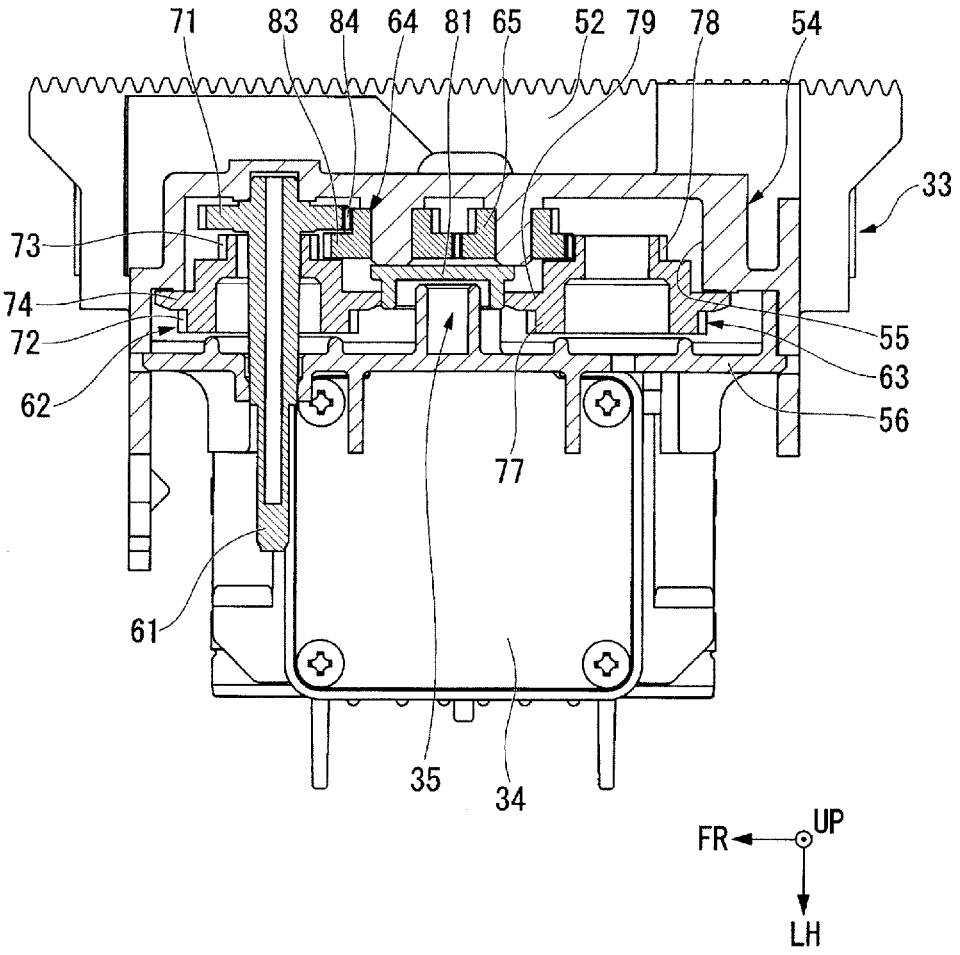
FIG. 10 is an explanatory diagram for explaining the operation method for the printer according to the first embodiment and is a sectional view equivalent to FIG. 5.

FIG. 10 is an explanatory diagram for explaining the operation method for the printer 1 and is a sectional view equivalent to FIG. 5.

As shown in FIGS. 8 and 10, in the backward-path printing step, since the second large gear 77 is in mesh with the winding rack 87, the second moving gear 63 moves forward relatively to the carriage 33 according to the backward movement of the carriage 33. Consequently, the second small gear 78 of the second moving gear 63 meshes with the reverse gear 65.

In this state, when the carriage 33 further moves backward, the second moving gear 63 rotates to the other side around the axis. When the second moving gear 63 rotates to the other side, the reverse gear 65 rotates in the opposite direction of the rotation of the second moving gear 63 (one side). When the reverse gear 65 rotates, the intermediate gear 64 rotates in the opposite direction of the rotation of the reverse gear 65 (the other side). When the intermediate gear 64 rotates to the other side, the winding shaft 61 rotates in the opposite direction of the rotation of the intermediate gear 64 (the one side) via the intermediate small gear 84. When the winding shaft 61 rotates to the one side, the bobbin of the cartridge 51 rotates. Consequently, as shown in FIG. 7, the carriage 33 moves backward while the ink ribbon of the cartridge 51 is wound. That is, in this embodiment, in both of the forward-path printing step and the backward-path printing step, when the winding shaft 61 rotates to the one side, the ink ribbon is wound in the same direction. Note that, in the backward-path printing step, when the first moving gear 62 slips out of the chipped tooth region K2 on the front side and meshes with the winding rack 87, the first moving gear 62 moves forward with respect to the carriage 33. Consequently, the meshing of the first small gear 73 of the first moving gear 62 and the reverse gear 65 is released. That is, in the backward-path printing step, in a state in which the first large gear 72 is in mesh with the winding rack 87, when the first small gear 73 separates from the reverse gear 65, the first moving gear 62 idles.

In the backward-path printing step, when the recording paper P is hit by the head pins of the printing head 34 via the ink ribbon, printing in a second row is performed on the recording paper P. Thereafter, when the printing head 34 passes a printing region of the second row of the recording paper P, the backward-path printing step ends.

Carriage-return Step

As shown in FIGS. 4 and 6, in the carriage-return step, after the printing head 34 passes the printing region of the second row of the recording paper P, the carriage 33 comes into contact with the backward-path engaging section 111 of the line-feed plate 101 from the front. When the carriage 33 further moves backward in this state, the line-feed plate 101 moves backward together with the carriage 33. Since the engaging projecting sections 113 are engaged in the engaging recessed sections 115, the line-feed plate 101 moves to the left side toward the back. Consequently, the entire printing block 12 moves to the left side toward the back.

At a point in time when the engaging projecting sections 113 approach or come into contact with the rear end portions of the engaging recessed sections 115, the carriage 33 reaches the backward-path end point (the forward-path start point). At this point in time, the driving in the reverse rotation direction of the printing motor 91 is stopped. Note that, after the carriage 33 passes the printing region of the second row in the recording paper P and before or after the carriage 33 comes into contact with the backward-path engaging section 111, the second moving gear 63 enters the chipped tooth region K1 on the rear side in the rack plate 67. Therefore, before or after approach to the carriage-return step, the second moving gear 63 does not rotate and the winding of the rink ribbon is not performed. Note that timing when the second moving gear 63 enters the chipped tooth region K1 can be changed as appropriate.

As shown in FIG. 2, when the carriage 33 returns to the forward-path start point, the platen motor 24 is actuated. Then, since a driving force of the platen motor 24 is transmitted to the platen main body 22 via the platen wheel train 25, the platen main body 22 lowers. Consequently, the holding of the recording paper P by the frame base 15 and the platen main body 22 is released. Thereafter, when the recording paper P is removed from the slot 5, the printing operation ends.

In this way, in this embodiment, the line-feed mechanism 100 includes the line-feed plate 101 supported to be movable in the front-back direction and the guide members 102 that guide the line-feed plate 101 in the left-right direction according to the movement in the front-back direction of the line-feed plate 101.

With this configuration, the carriage 33 engages with the forward-path engaging section 110 of the line-feed plate 101 while moving on the forward path. Therefore, when moving toward the forward-path end point thereafter, the carriage 33 moves to the right side together with the line-feed plate 101. On the other hand, the carriage 33 engages with the backward-path engaging section 111 of the line-feed plate 101 during the movement on the backward path. Therefore, when the carriage 33 moves toward the backward-path end point thereafter, the carriage 33 moves to the left side together with the line-feed plate 101. That is, the carriage 33 moves in different positions in the left-right direction between the forward path and the backward path. In this case, for example, by performing printing by the printing head 34 in both of the forward path and the backward path, it is possible to perform printing in printing regions in different two columns in the left-right direction of the recording paper P. As a result, it is possible to improve an information amount that can be printed at a time and improve marketability.

In particular, in this embodiment, since the carriage 33 is moved in the left-right direction according to the movement in the front-back direction, it is possible to perform a line-feed operation of the carriage 33 with one printing motor 91. Therefore, it is possible to realize simplification and a reduction in costs compared with, for example, when the line-feed operation of the carriage is performed by two printing motors, that is, a motor for performing the movement in the front-back direction and a motor for performing the movement in the left-right direction.

In this embodiment, since the engaging recessed sections 115 incline to the right side toward the front, it is possible to smoothly move the carriage 33 in the left-right direction according to the movement in the front-back direction of the carriage 33.

Moreover, in this embodiment, the bearing sections 46 regulate the swing of the printing frame 31 around the guide pillar 32 while supporting the guide pillar 32 to be movable in the left-right direction. Therefore, it is possible to achieve a reduction in the number of components, a reduction in costs, and improvement of assemblability compared with when the support of the guide plate 32 and the regulation of the swing of the printing frame 31 are performed by separate components.

In this embodiment, the ink ribbon is wound according to the movement of the carriage 33. Therefore, it is possible to suppress occurrence of a change in printing concentration, printing blur, and the like and keep printing quality satisfactorily.

In this embodiment, in the line-feed step and the carriage-return step of the carriage 33, the chipped tooth regions K1 and K2 for releasing the meshing of the large gears 72 and 77 on a winding side (a side on which the winding shaft 61 is rotated) in the moving gears 62 and 63 and the winding rack 87 are formed on the rack plate 67.

With this configuration, when the carriage 33 passes both the end portions in the front-back direction of the rack plate 67, the moving gears 62 and 63 on the winding side do not rotate according to the movement of the carriage 33. That is, the winding of the ink ribbon is not performed during the movement in the chipped tooth regions K1 and K2. Therefore, it is possible to suppress load torque required for the winding in the line-feed step and the carriage-return step from acting on the printing motor 91 and smoothly perform the line-feed operation. Since it is possible to suppress the ink ribbon from being uselessly wound in the line-feed step and the carriage-return step, it is possible to effectively use the ink ribbon.

Since the printer 1 in this embodiment includes the printing unit 3, it is possible to improve marketability.

Modification

A modification of the first embodiment is explained.

Note that, in the embodiment explained above, the engaging projecting sections 113 are formed in the line-feed plate 101 and the engaging recessed sections 115 are formed in the guide members 102. However, conversely, the engaging recessed sections 115 may be formed in the line-feed plate 101 and the engaging projecting sections 113 may be formed in the guide members 102.

In the embodiment explained above, the two engaging projecting sections 113 and the two engaging recessed sections 115 are provided. However, the number of the engaging projecting sections 113 and the engaging recessed sections 115 is not limited to two and may be one or three or more. If one engaging projecting section 113 and one engaging recessed section 115 are provided, rails and the like for guiding the movement in the left-right direction of the printing block 12 may be separately provided.

Note that, engaging timing and an engaging method for the carriage 33 and the engaging sections 110 and 111 can be designed and changed as appropriate.

Figure 11:
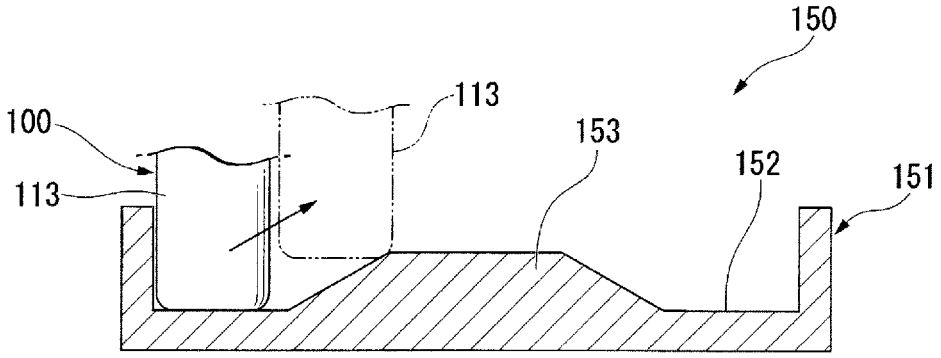
FIG. 11 is a sectional view corresponding to line XII-XII in FIG. 6.

FIG. 11 is a sectional view corresponding to line XII-XII in FIG. 6. Note that, in the following explanation, components same as the components in the first embodiment are denoted by the same reference numerals and signs and explanation of the components is omitted.

In a line-feed mechanism 150 shown in FIG. 11, a locking section 153 locked in the engaging projecting section 113 is formed in an engaging recessed section 152 of a guide member 151. Specifically, the locking section 153 swells upward from the center in an extending direction of the engaging recessed section 152 in the bottom of the engaging recessed section 152. A cross section along the extending direction of the locking section 153 is formed in a trapezoidal shape. Specifically, both end portions in the extending direction of the locking section 153 are formed as inclined surfaces extending upward toward the center of the locking section 153. The center in the extending direction in the locking section 153 is formed as a flat surface.

With this configuration, in a state in which the engaging projecting sections 113 are located at both end portions in the extending direction in the engaging recessed section 152, movement of the engaging projecting section 113 to the center in the extending direction is regulated by the locking section 153. Consequently, for example, when a shock acts on the printer 1 from the outside, it is possible to suppress the line-feed plate 101 from suddenly moving. Note that, in the line-feed step and the carriage-return step explained above, the line-feed plate 101 moves together with the carriage 33 in a state in which the carriage 33 engages with the forward-path engaging section 110 or the backward-path engaging section 111. Therefore, the engaging projecting sections 113 climb over the locking section 153. Consequently, the line-feed step and the carriage-return step are performed according to action same as the action in the embodiment explained above.

Note that, in the explanation in the modification, the locking section 153 is formed in the bottom of the engaging recessed section 152. However, not only this, but a locking section may be formed on the inner side surface of the engaging recessed section 152.

In the modification explained above, one locking section 153 is formed in the center in the extending direction in the engaging recessed section 152. However, not only this, but locking sections may be formed respectively at both the end portions in the extending direction in the engaging recessed section 152.

Second Embodiment

A second embodiment of the present invention is explained. The second embodiment is different from the first embodiment in that cam members 201 are adopted in a line-feed mechanism 200. Note that, in the following explanation, components same as the components in the first embodiment explained above are denoted by the same reference numerals and signs and explanation of the components is omitted.

Figure 12:
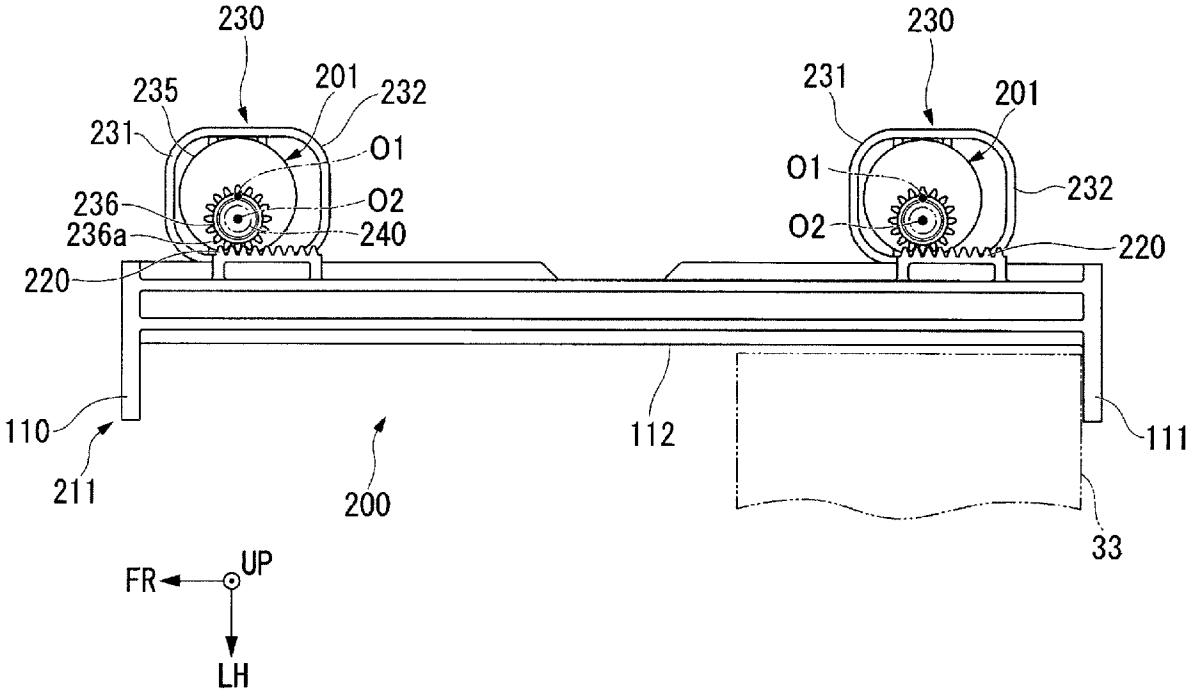
FIG. 12 is a plan view of a line-feed mechanism according to a second embodiment viewed from above.

FIG. 12 is a plan view of the line-feed mechanism 200 according to the second embodiment viewed from above.

As shown in FIG. 12, in the line-feed mechanism 200 in the second embodiment, line-feed racks 220 are formed on a line-feed plate 211. The line-feed racks 220 project from both end portions in the front-back direction in the line-feed plate 211 toward the right side and extend in the front-back direction.

Figure 13:
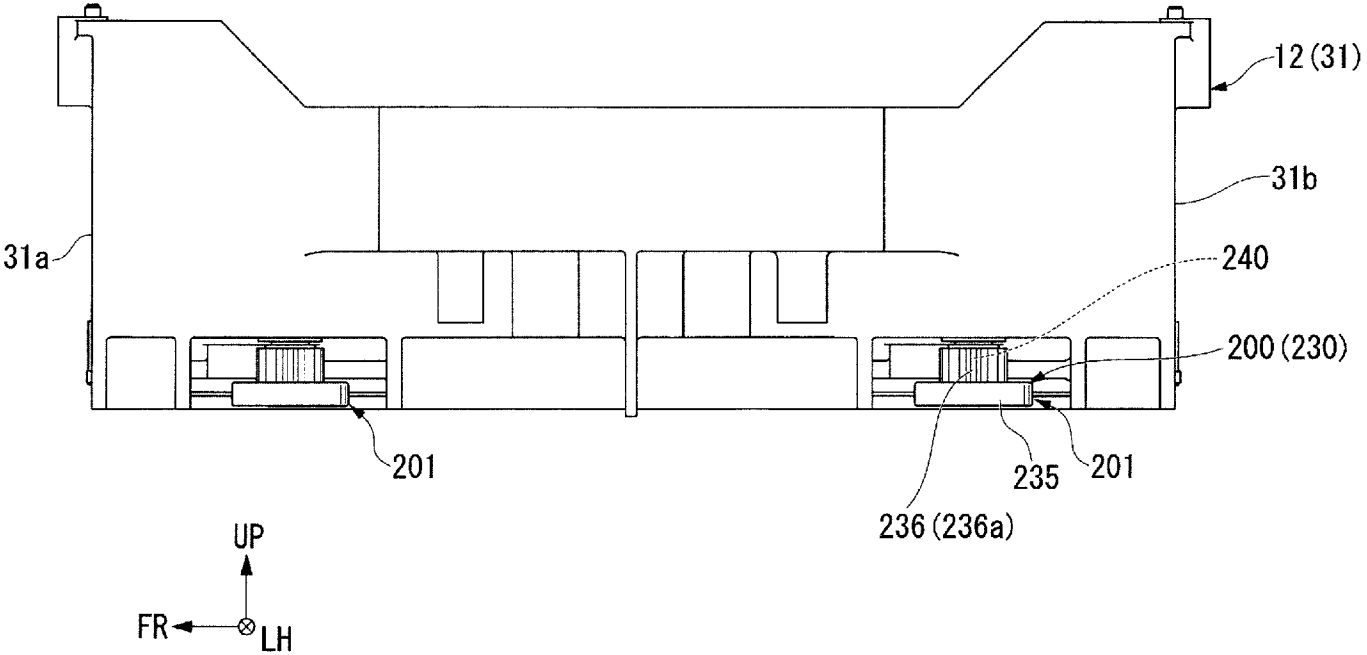
FIG. 13 is a side view of a printing block according to the second embodiment viewed from the right side.

FIG. 13 is a side view of a printing block 210 according to the second embodiment viewed from the right side.

As shown in FIGS. 12 and 13, guide members 230 of the line-feed mechanism 200 include slope guides 231 and the cam members 201.

As shown in FIG. 12, the slope guides 231 are respectively disposed in positions overlapping the line-feed plate 211 in up-down direction at both the end portions in the front-back direction in the frame base 15 (see FIG. 3) explained above. The slope guides 231 include guide walls 232 surrounding the bottoms of the slope guides 231. The guide walls 232 are formed in a rectangular frame shape in plan view from above.

The cam members 201 include base plates 235 and cam gears 236.

The base plates 235 are formed in circular shapes centering on axes O1 extending in the up-down direction. The base plates 235 are housed in the slope guides 231 (on the inner sides of the guide walls 232) to be rotatable around the axes O1 and movable mainly in the front-back direction. Note that, in the guide walls 232, the distance between inner side surfaces opposed to each other in the left-right direction is set equal to the outer diameter of the base plates 235. Therefore, the outer circumferential surfaces of the base plates 235 are close to or in contact with the inner side surfaces opposed to each other in the left-right direction in the guide walls 232.

The cam gears 236 are formed in cylindrical shapes extending upward along eccentric axes O2 eccentric in the radial direction with respect to the axes O1. Support pins 240 projecting downward from the printing frame 31 are respectively inserted through the cam gears 236. That is, the cam members 201 are supported by the printing frame 31 to be rotatable around the eccentric axes O2.

On the outer circumferential surfaces of the cam gears 236, tooth sections **236*a* projecting to the outer side in the radial direction in the eccentric axes O2 are formed over the entire circumferences. The tooth sections 236*a* of the cam gears 236 are in mesh with the line-feed racks 220** corresponding thereto.

Figure 14:
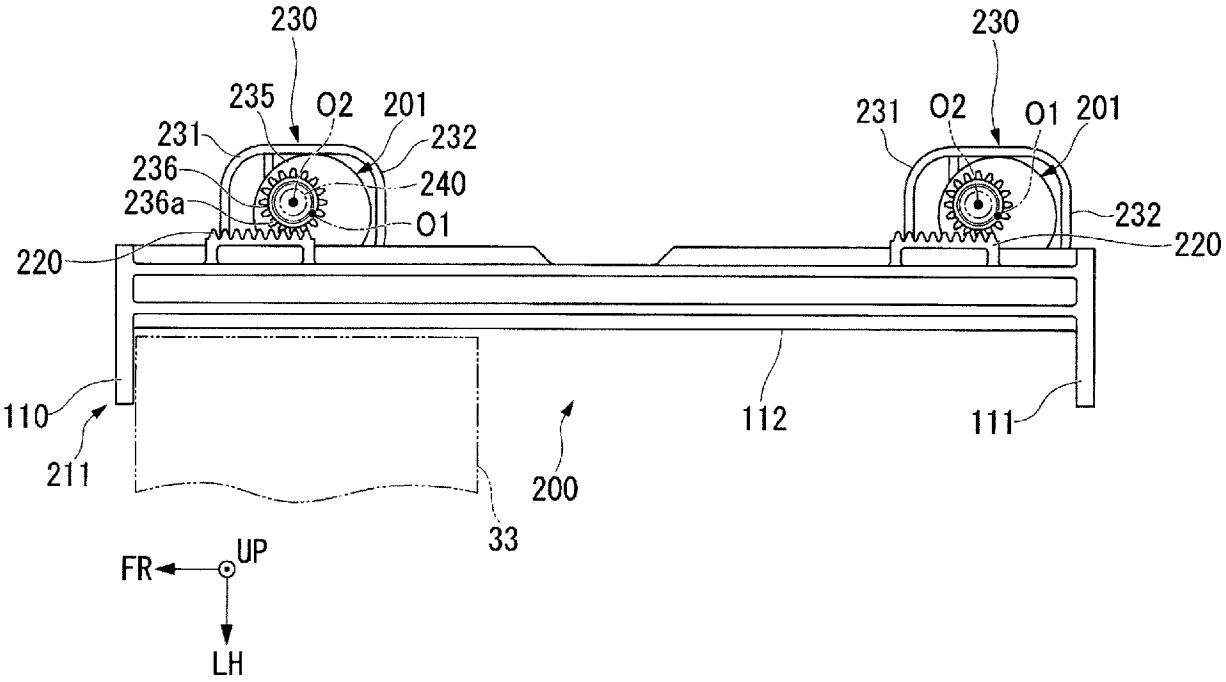
FIG. 14 is an explanatory diagram for explaining an operation method for a printer according to the second embodiment and is a plan view equivalent to FIG. 12.

FIG. 14 is an explanatory diagram for explaining an operation method for the printer 1 and is a plan view equivalent to FIG. 12.

With this configuration, in the line-feed step, as shown in FIG. 14, in a state in which the carriage 33 is in contact with the forward-path engaging section 110 of the line-feed plate 211 from the back, when the carriage 33 moves further forward, the line-feed plate 211 moves forward together with the carriage 33. Then, since a forward driving force of the line-feed plate 211 is transmitted to the cam members 201 via the cam gears 236, the cam gears 236 (and the support pins 240) are about to rotate around the axes O1. At this point, the cam members 201 (the base plates 235) are housed in the slope guides 231 to be movable in the front-back direction. Therefore, the cam members 201 move backward in the slope guides 231 (in the guide walls 232) while rotating to one side around the axes O1. Consequently, the cam gears 236 (and the support pins 240) linearly move to the right side. As a result, the entire printing block 12 moves to the right side toward the front.

On the other hand, in the carriage-return step, as shown in FIG. 12, in a state in which the carriage 33 is in contact with the backward-path engaging section 111 of the line-feed plate 211 from the front, when the carriage 33 further moves backward, the line-feed plate 211 moves backward together with the carriage 33. Then, since a backward driving force of the line-feed plate 211 is transmitted to the cam members 201 via the cam gears 236, the cam members 201 move forward in the slope guides 231 (in the guide walls 232) while rotating to the other side around the axes O1. Consequently, the cam gears 236 (and the support pins 240) linearly move to the left side. As a result, the entire printing block 12 moves to the left toward the back.

In this way, in this embodiment, the cam members 201 rotate according to the movement in the front-back direction of the carriage 33. Therefore, it is possible to smoothly move the printing block 12 in the left-right direction according to the rotation of the cam members 201.

In this embodiment, the cam members 201 and the line-feed plate 211 are engaged by the cam gears 236 and the line-feed racks 220. Therefore, it is possible to achieve simplification. Compared with when the cam members 201 and the line-feed plate 211 are engaged by pins, through-holes, and the like, it is possible to reduce a load acting on engaging portions.

In the above explanation in the second embodiment, the cam members 201 and the line-feed plate 211 are engaged by the cam gears 236 and the line-feed racks 220. However, the present invention is not limited to this. For example, it is also possible that the cam members 201 and the line-feed plate 211 are engaged by a link mechanism and the cam members 201 are moved in the front-back direction in the slope guide 231.

Note that, in the above explanation in the second embodiment, the entire cam members 201 move in the front-back direction in the slope guides 231. However, the present invention is not limited to this. The cam members 201 may only rotate around the axes O1 in the slope guides 231 (movement in the front-back direction is regulated).

Guide grooves or the like for supporting the support pins 240 to be movable in the left-right direction may be provided in the slope guide 231.

Further, the line-feed plate 211 and the cam members 201 may be engaged by pins, through-holes, and the like.

Note that the technical scope of the present invention is not limited to the embodiments explained above. It is possible to add various changes to the technical scope without departing from the spirit of the present invention.

For example, in the explanation in the embodiments, the printer 1 of the present invention is applied to the printer 1 of the dot impact type. However, the present invention is not limited to this. For example, the printer 1 may be applied to, for example, an inkjet printer and a thermal printer. The use of the printer 1 is not limited to the timestamp.

In the explanation in the embodiments, the printing is performed in both of the forward path and the backward path. However, the printing may be performed in at least one of the forward path and the backward path (e.g., only the first row may be printed or only the second row may be printed).

An engaging method for the line-feed plate and the guide members can be changed as appropriate. For example, the line-feed plate and the guide members may be engaged by a worm gear mechanism or a link mechanism.

The chipped tooth regions K1 and K2 of the rack plate 67 may be absent.

Besides, the components in the embodiments explained above can be replaced with well-known components as appropriate without departing from the spirit of the present invention. The embodiments may be combined as appropriate.

What is claimed is:

1. A printing unit comprising:

a carriage;

a printing head mounted on the carriage;

a guide pillar configured to support the carriage to be reciprocatingly movable in a row direction;

a unit frame configured to support the guide pillar to be movable in a column direction orthogonal to the row direction; and a line-feed mechanism configured to move the carriage in the column direction, wherein the line-feed mechanism includes:

a line-feed plate supported by the guide pillar and movable in the row direction; and a guide member configured to engage with the line-feed plate and guide the line-feed plate in the column direction together with the guide pillar according to the movement in the row direction of the line-feed plate, and the line-feed plate includes:

a forward-path engaging section with which the carriage engages in a process from a forward-path start point to a forward-path end point in the row direction; and a backward-path engaging section with which the carriage engages in a process from a backward-path start point to a backward-path end point in the row direction, the forward-path engaging section and the backward-path engaging section connected by a line-feed base that spans the guide pillar and supports the guide member.

2. The printing unit according to claim 1, wherein, in a first member of the line-feed plate and the guide member, an engaging projecting section resides that projects toward a second member, an engaging recessed section, with which the engaging projecting section engages, resides in the second member, and the engaging recessed section extends to one side in the column direction and toward one side in the row direction.

3. The printing unit according to claim 2, wherein a locking section, which the engaging projecting section can climb over, resides in a center in an extending direction in the engaging recessed section on an inner surface of the engaging recessed section.

4. The printing unit according to claim 1, wherein the guide member includes a cam member configured to rotate on the unit frame around an axis orthogonal to the row direction and the column direction, and to engage with the line-feed plate in a position eccentric with respect to the axis and to move the line-feed plate in the column direction together with the guide pillar according to the movement in the row direction of the line-feed plate.

5. The printing unit according to claim 4, wherein the cam member includes a cam gear in a position eccentric with respect to the axis, and the line-feed plate includes a line-feed rack configured to mesh with the cam gear.

6. The printing unit according to claim 1, further comprising:

a driving source configured to move the carriage in the row direction;

a printing frame mounted with the driving source and configured to support the guide pillar; and a bearing section in the unit frame and configured to support the guide pillar to be reciprocatingly movable in the column direction, and coupled to the printing frame to regulate a swing of the printing frame around the guide pillar.

7. The printing unit according to claim 1, wherein the printing head is an impact printing head and includes a winding mechanism connected to and detachably attached to carriage and configured to wind an ink ribbon in the cartridge, the winding mechanism includes:

a winding gear in the carriage; and a rack plate including a winding rack that meshes with the winding gear, and the winding gear rotates according to the movement in the row direction of the carriage and the winding mechanism performs the winding of the ink ribbon.

8. The printing unit according to claim 7, wherein the rack plate includes chipped tooth regions configured to release the meshing of the winding gear and the winding rack at both end portions in the row direction.

9. A printer comprising:

the printing unit according to claim 1; and a casing configured to house the printing unit and including a slot into which a recording medium is inserted.

* * * * *